United States Patent [19]

Van Wilder et al.

[11] Patent Number: 4,991,913

[45] Date of Patent: Feb. 12, 1991

[54] TRASH BIN ASSEMBLY

[76] Inventors: Christian Van Wilder, 1278 Av. La Lorraine, Sainte Foy, Quebec, Canada, G1W 3Y4; Patrick Van Wilder, 5781, Cote St-Luc app. 14, Hampstead, Quebec Canada H3X 2E8

[21] Appl. No.: 460,036

[22] Filed: Jan. 2, 1990

[51] Int. Cl.[5] ..... A47B 81/00

[52] U.S. Cl. ..... 312/275; 312/319

[58] Field of Search ..... 312/274, 275, 319

[56] References Cited

U.S. PATENT DOCUMENTS

| | | | |
|---|---|---|---|
| 2,311,835 | 2/1943 | Johnson | 312/275 |
| 2,530,336 | 11/1950 | Marini | 312/274 |
| 2,702,224 | 2/1955 | Goldberg | 312/274 |
| 2,837,395 | 6/1958 | Carani | 312/275 |
| 3,014,684 | 12/1961 | Gould | 312/275 |

*Primary Examiner*—Joseph Falk

[57] ABSTRACT

A trash bin for a kitchen cabinet door, having a lid which is constantly spring biased to opened position. The lid has a central upwardly projecting plank, outwardly tapering thicknesswise for slidingly engaging the lower edge of the lintel of the cabinet front wall opening, whereby the lid causes opening of the door. By using a conventional push releasable latch on the door, the door and bin lid will automatically open, by simply pushing the outer face of the closed door, e.g. with a foot. Thus, it is not necessary to use a hand either for opening the door or the lid.

9 Claims, 7 Drawing Sheets

TRASH BIN ASSEMBLY

FIELD OF THE INVENTION

This invention relates to kitchen wares, and more particularly to trash bins for kitchen counters or cabinets, having a lid which can be automatically opened and closed.

BACKGROUND OF THE INVENTION

Trash bins are often conveniently secured to the inner face of an access door of a kitchen sink cabinet, for releasable engagement into the cabinet compartment under the sink. It is useful to have a trash bin the lid of which can be automatically opened and closed as the door is opened and closed. This of course more quickly frees one hand of the user for positioning trash within the bin. Such automatic lid-operating devices have been known for some time.

For instance, in U.S. Pat. No. 2,311,835 to Charles M. Johnson, lid 8 is hinged at 11 to trash bin 7 and biased in open position by a spring 13 interconnecting the rear wall of the bin with an upper section of the hinge 11. Bin 7 is anchored to the door 3 of a cabinet defining an opening 2 in which door 3 swings to close the compartment 4 in the cabinet. A spring bar 15 is connected to the top of lid 8 and comes in frictional contact with the front upper board 7 of the cabinet when the door 3 is closed, whereby the lid is closed against the bias of spring 13.

In this patent to Johnson, as shown in FIG. 1, the large angle (about 45°) made between lid bar 15 and the plane passing through the bottom edge of top board 17, which is necessary since that blade 15 is straight and parallel to lid 8, does mean that one will need to use relatively substantial force to close the lid, and that the initial closing effort is much larger than that of the final closing. Also, the spring 13 cannot be used to also open the door.

A drawback in existing trash bins is that one always needs to have at least one free hand to grip the access door of the kitchen sink cabinet, in order to pull open same when access to the trash bin is required. This is not advantageous, in that it occasionally happens that both hands are required to carry the garbage load to the trash bin, and thus said load must be put on the ground or on the kitchen counter before opening the door.

OBJECTS OF THE INVENTION

The main object of the invention is to provide means for the automatic opening of both the lid of the trash bin and the door of a kitchen sink cabinet, whereby no hand is required for these purposes.

A further object of the invention is that said automatic means also closes said lid concurrently with the closing of the door.

SUMMARY OF THE INVENTION

In accordance with the objects of the invention, there is disclosed a trash bin assembly comprising, in combination, a trash bin assembly comprising a receptacle, a top lid therefor pivoted thereto about a lid pivotal axis for movement between an open and a closed position, said receptacle having a flat back wall adapted to be mounted against the inside face of a kitchen counter door, hinged to a door frame which is part of said counter, and spring means carried by said receptacle and acting on said door frame and on said lid to bias both said door and said lid to open position.

Preferably, said spring means includes a spring member acting directly on said receptacle and on said lid to open the latter, and an elongated cam member carried by and over said lid and extending at an angle to said back wall, said cam member having a cam edge downwardly inclined in a direction away from said back wall, said cam edge slidably engageable with the lintel of said door frame to cause door-opening movement through the opening of said lid under the action of said spring member.

Advantageously, said lid pivotal axis is substantially normal to said back wall, said cam member extending in a direction away from said back wall and protruding from said lid at a distance from said lid pivotal axis.

Profitably, said cam edge defines a rear portion with a top, flat, substantially horizontal edge engaging the underside of said lintel in the closed position of said door and maintaining said lid in closed position.

Preferably, said cam edge defines a steeply-inclined cam edge section following said top edge, in turn followed by a less-inclined cam edge section.

Advantageously, said receptacle has a top edge which is downwardly inclined away from said back wall, and said lid is downwardly inclined away from said back wall when in closed position.

It is envisioned that said top lid be pivoted to said receptacle by means of a hinge member having two flat leaves, said top lid and said receptacle being provided with sockets on each side thereof for removably receiving said hinge leaves, whereby said lid can be pivoted to either side of said receptacle, the side selected being either the door on which the receptacle is mounted is a left-hand or a right-hand opening door.

Said spring member should be a tension coil spring extending on the outside of said receptacle and selectively attachable to either side of said receptacle at one end and at the other end to a bar pivoted to the underside of said lid and swingeable to any of two positions protruding from a selected one of the two sides of said lid beyond the pivotal axis of said lid.

In accordance with a second embodiment, said spring means includes a bracket secured to the bottom of said receptacle, a sleeve pivotally mounted on said bracket for movement about an axis normal to said bottom, a rod member slidable in said sleeve transversely of said receptacle and under the same, said rod member having an outer end protruding from the side of said receptacle, a yoke pivotally mounted to said outer end of said rod and adapted to be fixed to a jamb of said door frame in such a position that the pivotal connection of the rod to the yoke be parallel to and spaced from the pivotal axis of said door to said door frame; an annular seat fixed to said rod adjacent said yoke; a compression coil spring surrounding said rod and extending between and abutting against said seat and said sleeve to bias said door to open position; and further including flexible cord means having one end attached to said rod adjacent said seat and the other end attached to said lid, said cord means including a flexible cord slidably extending through a guide block fixed to the side of said receptacle, said cord means causing opening of said lid upon opening movement of said door.

Advantageously, stop means limit the opening movement of said lid to an upwardly-inclined limit position, whereby said lid closed by gravity upon release of the tension of said cord means during closing movement of said door.

DETAILED DESCRIPTION OF THE INVENTION

Figure 1:
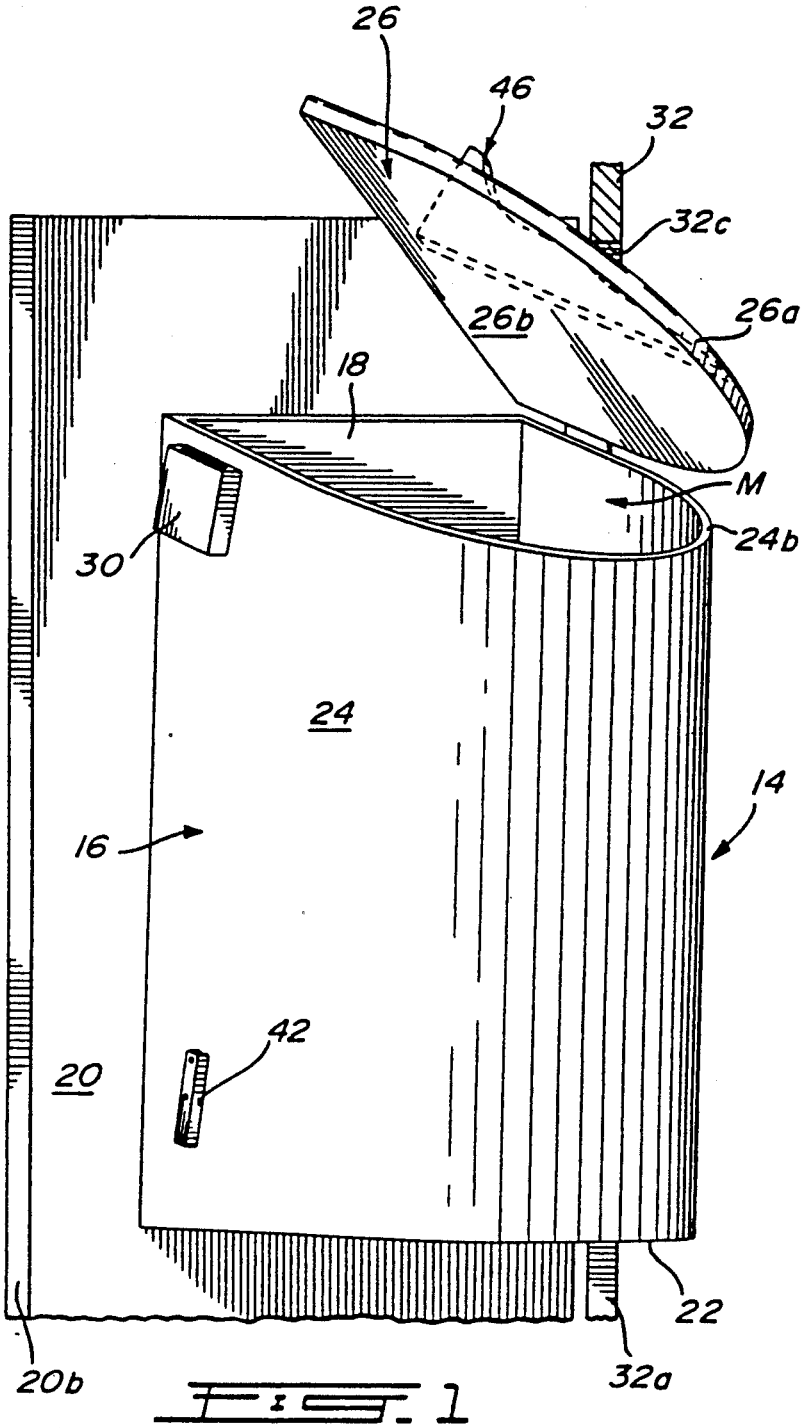
FIG. 1 is a perspective view of a trash bin mounted to a kitchen sink cabinet door, in accordance with a first embodiment of the invention, the lid thereof being partially opened.
Figure 2:
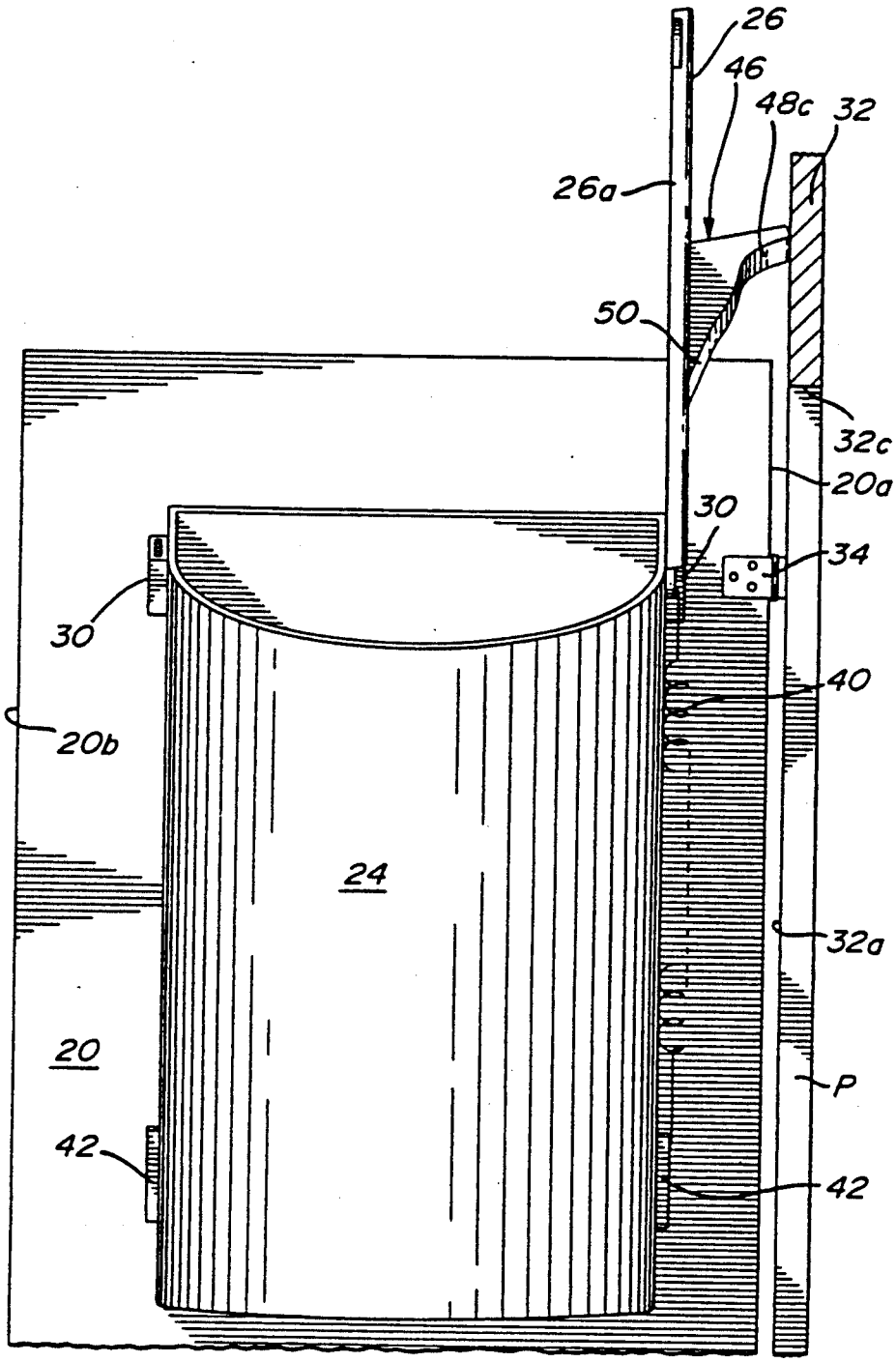
FIG. 2 is a front elevational view of the bin and door of FIG. 1, the lid being completely opened.

Trash bin 14 consists of a rigid container or receptacle 16 defining a flat rectangular back panel 18, being flatly anchored by a bracket B or the like to the door 20 of a cabinet (not shown) such as the one of a kitchen sink. A flat floor 22 is provided, and a cross-sectionally semi-circular wall 24 edgewisely joins panel 18 to floor 22. Peripheral wall 24 defines a bottom edge **24*a*, which is horizontal i.e. orthogonal to door 20, and a top edge 24*b*, which downwardly outwardly tapers. A semi-circular cover or lid 26 is hinged at hinge 28 to one outward side edge section of top wall edge 24*b*, for pivotal action about an axis normal to back wall 18 and parallel to the plane passing through edge 24*b*. The hinge leaves can be permanently fixed to lid 26 and wall 24. However, it is preferred that these leaves be releasably locked within sockets 30, fixed to each side of bin 14 and of lid 26. Thus, the lid can be made to open at the right or left of the bin depending on whether the bin is mounted on a left hand or right hand opening door 20. In closed position, the peripheral edge section 26*a* of lid 26 abuts directly against and conforms to the shape of top edge 24*b* of semi-circular side wall 24**.

The kitchen sink cabinet defines a compartment (not shown) for housing inter alia the trash bin 14. The front wall of the cabinet has a large opening P formed by a door frame which includes a lintel 32 and jambs **32*a*, 32*b*. The door 20 is edgewisely hinged by any type of hinge 34 at vertical edge section 20*a* to the jamb 32*a*, for pivotal movement about a vertical axis. The opposite vertical edge section 20*b* of the door 20 conventionally abuts against the opposite jamb 32*b***, when the door is closed.

In accordance with the teachings of the invention, biasing means 36 are provided to constantly bias the trash bin lid 26 in open position.

The biasing means 36 includes a tension coil spring 40, anchored at its bottom end to a bracket 42 which is fixedly secured to a lower section of bin wall 24 in vertical register with hinge 28 and at its top end to a lug **44*a* projecting from lid 26 beyond hinge 28**.

An additional lug **44*b* and an additional bracket 42 are secured to the opposite side of lid 26 and bin wall 24, for mounting the spring 40 when the lid 26 is pivoted to the trash bin 14 on the opposite side when taking in consideration on which side the kitchen sink door 20 is pivotally mounted to its supporting kitchen wall 32**.

Figure 3:
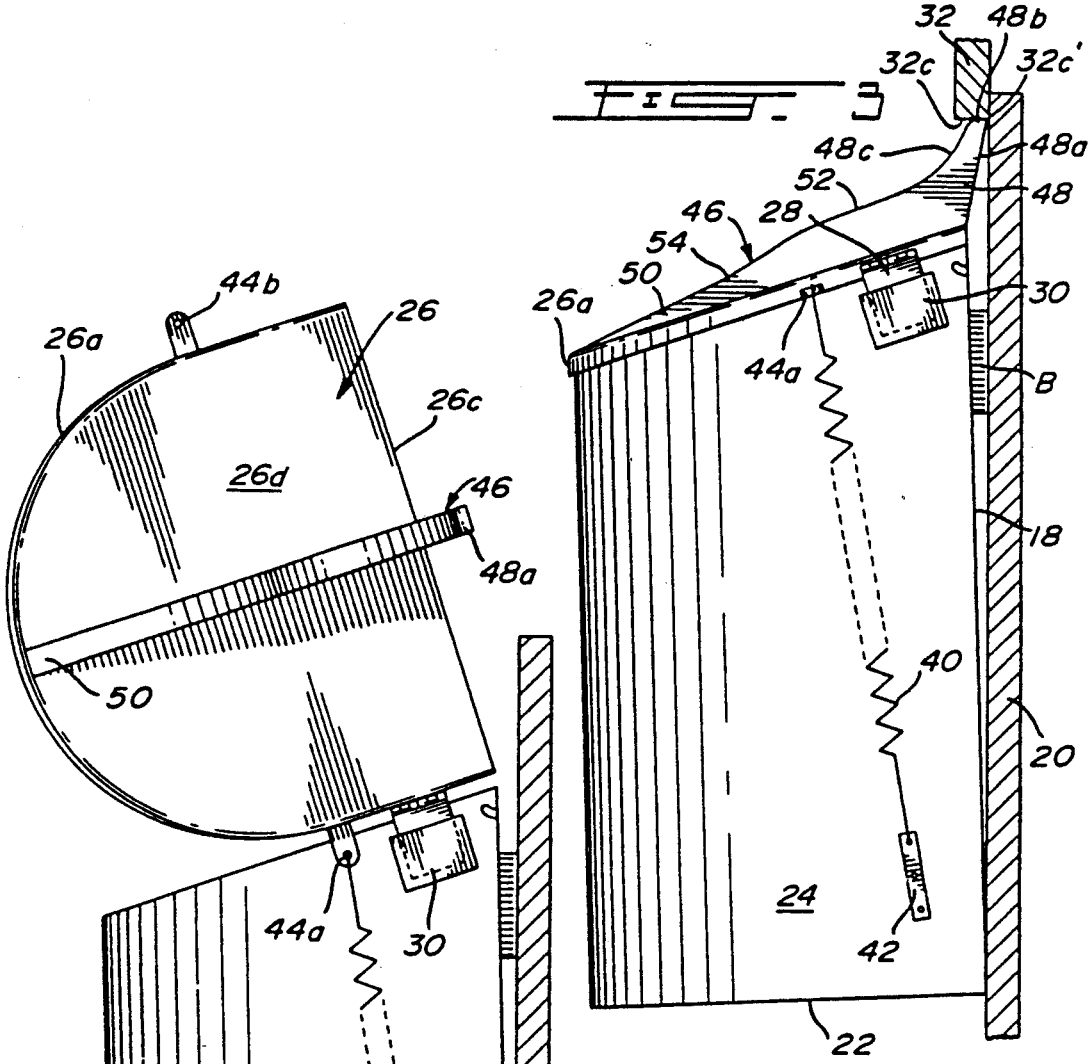
FIGS. 3–4 are side elevational views of the bin of FIG. 1 and sectional views of the cabinet door, sequentially suggesting how the bin lid automatically opens when the cabinet door opens.
Figure 4:
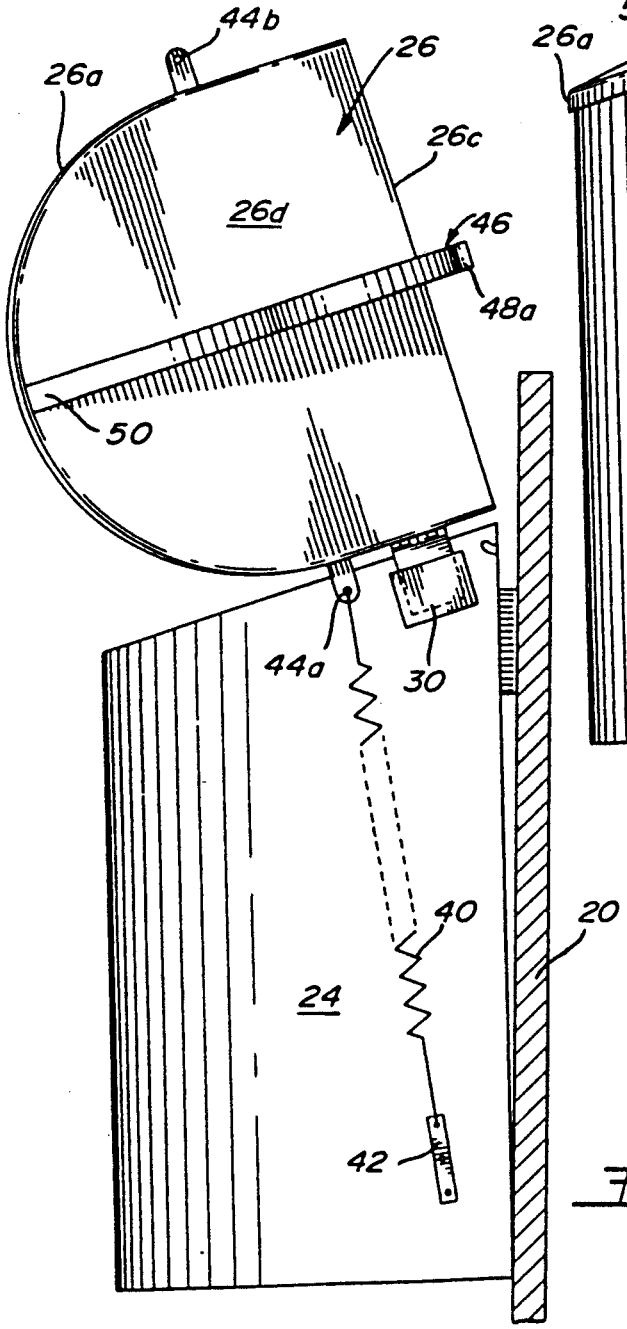
Figure 5:
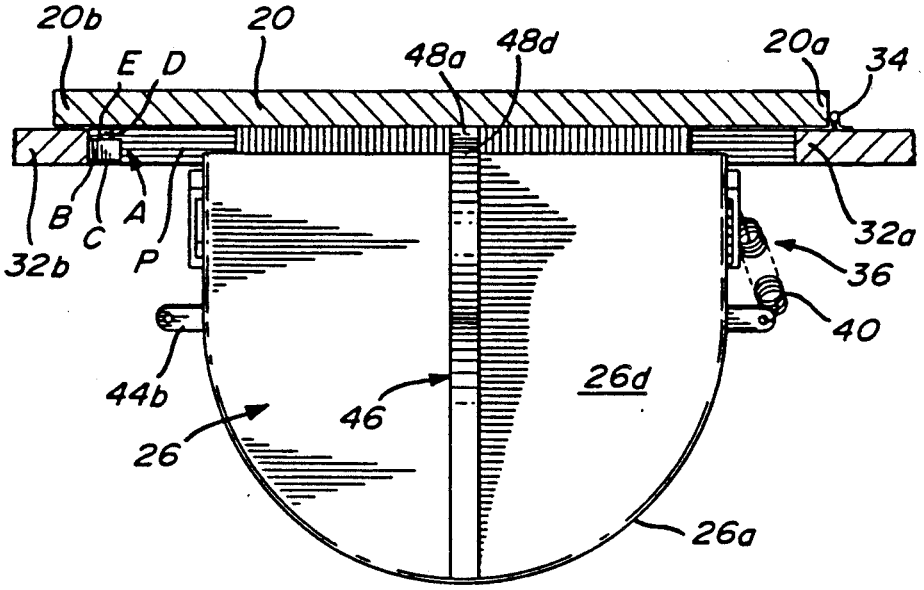
FIG. 5 is a top end view of the bin of FIG. 1 and cross-sectional view of the cabinet door.
Figure 6:
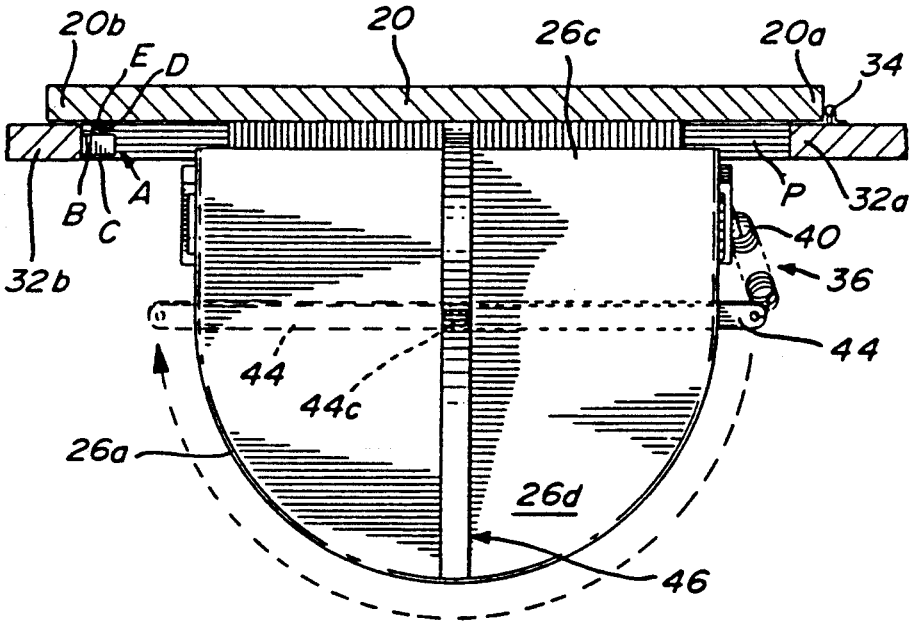
FIG. 6 is a view similar to FIG. 5 showing another means to attach the tension spring to the lid.

Instead of providing two fixed lugs **44*a*, 44*b* as shown in FIGS. 3, 4 and 5, a single flat rod 44 may be pivoted under the central part of lid 26 at 44*c* for right hand or left hand use as shown in FIG. 6**.

A cam plank 46 is fixedly secured to the top surface **26*d* of lid 26, and extends at right angle to its inner straight edge 26*c* centrally of lid 26 and normal thereto. The height of plank 46 tapers from a highest section 48, over back lid edge 26*c*, to a lowermost section 50 over front lid edge 26*a*. Highest section 48 defines: an outer elongated flat edge 48*a*, which merges with the lid inner edge section 26*c* and which upwardly projects beyond the plane of the bin inner flat wall 18 be an angle of about 10–15°; a small top flat edge 48*b*, and a steep outward concave edge 48*c* at the end of which plank 46 has about half the height of section 48. Between sections 48 and 50, edge section 48*c* is followed by a substantially straight inner section 52, of about equal plank height, and by a height tapering outer half section 54 merging with lowermost plank section 50. The junction of sections 52, 54 is located about midway of the length of cam plank 46. Edges 48*b*, 48*c*, 52 and 54** form a continuous camming surface.

Top edge **48*b* abuts against the lower edge 32*c* of the lintel when the door 20 is closed, thereby positively closing lid 26 over bin 16 against the bias of spring 40**.

It will be understood that, upon slight initial opening of the closed door 20, top edge **48*c* of plank 46 clears the lower lintel edge 32*c* and thereafter, the lid opening force exerted by spring 40 will cause the camming surface to engage lintel edge 32*c* and cause door opening. Immediately after top edge 48*b* clears lintel edge 32*c*, the lid 26 is still closed and horizontal and the lever arm formed between door hinges 34 and the contact of the cam plank 46 with lintel edge 32*c* is a maximum. This lever arm gradually shortens as lid 26 opens. This is why the initial effort to open the door 20 is greater, hence the steep slope of edge 48*c* merging with top edge 48*b*. The portion of the camming surface which follows edge 48*c* is shaped to cause door opening sufficiently to gain easy access to bin 14. Closed door 20 could be initially opened by hand but, it is much preferred to use the bin assembly on a door 20 provided with a conventional push-type magnetic latch a. This latch includes a casing B fixed to jamb 32B in which is slidable a spring loaded plunger C having a permanent magnet head D adhering to a steel plate B fixed to the inside of door 20 at its free edge 20*b*. A slight push with a knee or foot on the door cause the plunger C to open the door sufficiently for top edge 48 to clear lintel edge 32*c*; the biasing force of spring 40** will then force the door open, without it being necessary for the person to pull the door.

It is noted that because lid 26 is downwardly forwardly inclined when closed, it enables to use a cam plank.

In the second embodiment shown in FIGS. 7 to 10, the means to automatically open the door and the lid comprise a cylindrical rod 56 slidably mounted within a sleeve member 58, which is pivoted at rivet 60 to a bracket 62 anchored to the bottom 22 of bin 24', whereby sleeve 58 and associated rod 56 are pivotable about a vertical axis passing through rivet 60. One end of rod 56 is pivoted about an axis parallel to that of rivet 60, by a pivotal axle 64 carried by a yoke member 66 which is anchored to the inside face of the lower end of jamb 32*a*, while the opposite end thereof includes an enlarged head 68. Head 68 is diametrally larger than the boring 58*a* of sleeve 58, to prevent withdrawal thereof as suggested in phantom lines in FIG. 8. Yoke member 66 is positioned inwardly relative to the door pivotal axis, i.e. nearer to the door opening P than hinge 34. Therefore, since axes 64 and 34 are transversely offset, when door 20 is opened/closed, rod 56 slidingly reciprocates within the boring 58*a* of the sleeve member 58, see FIG. 8. To provide for greater door opening than shown in FIG. 8, yoke 66 could be located in the plane of jamb 32*a*.

A compression coil spring 70 is mounted around rod 56, between sleeve 58 and yoke 66. Spring 70 is compressed therebetween, so as to push against sleeve 58, that is to say, to bias sleeve 58 to slide outwardly along rod 56, i.e. to bias the door 20 from its closed to its opened position. Coil spring 70 abuts at its inner end against an annular seat 72, anchored to rod 56 at a short distance from yoke 66, so that spring 70 does not hamper the rotation of rod 56 about axle 64 during pivotal motion of the door 20. An adjustable set screw 57, carried by sleeve 58 abuts rod 56 at the end of the door opening movement. Thus, the limit opened position of the door can be adjusted.

Figure 7:
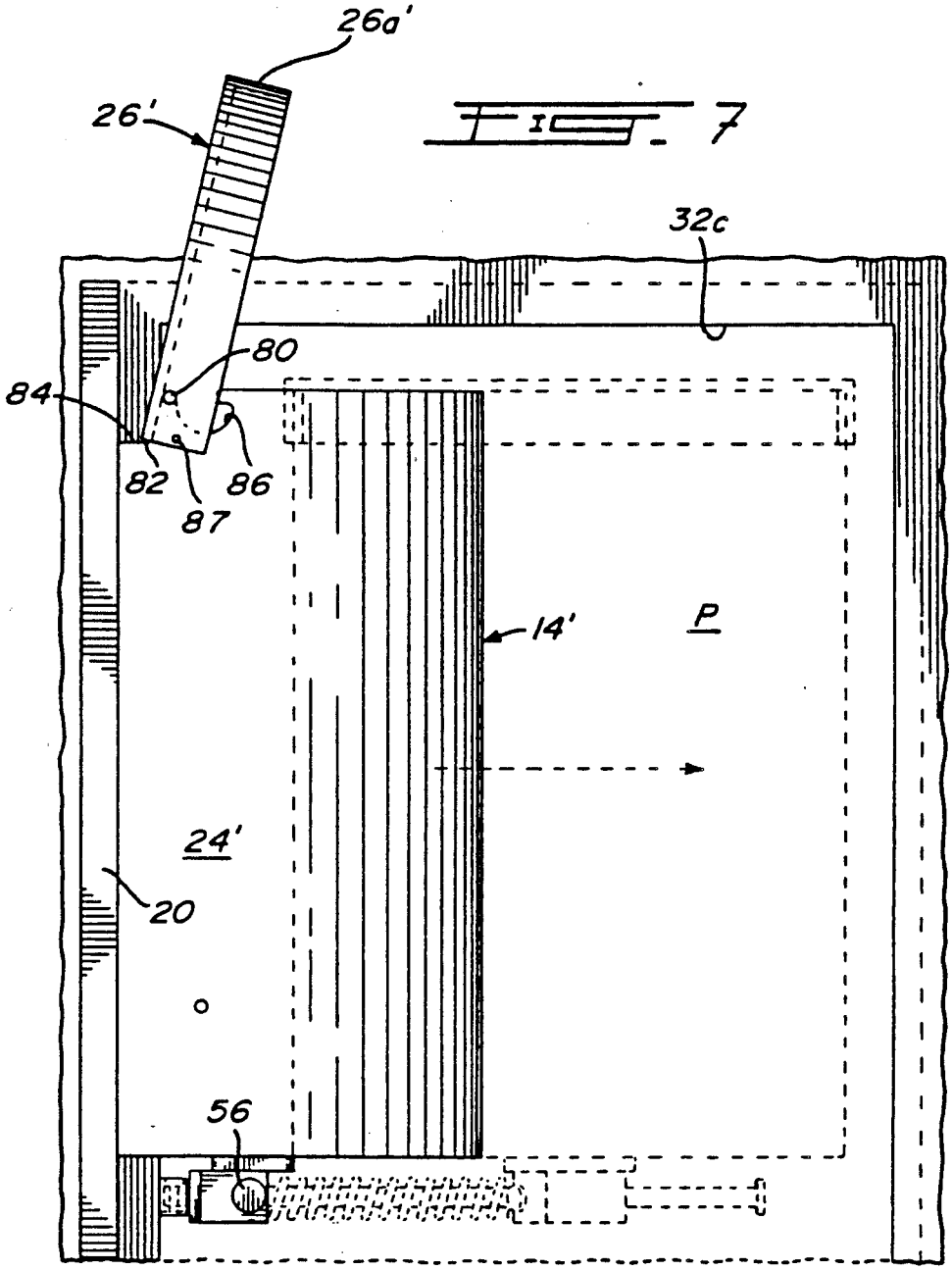
FIG. 7 is a side elevation of a trash bin mounted on an open kitchen sink counter door according to a second embodiment of the invention, also showing in dash line the closed position of the bin.
Figure 8:
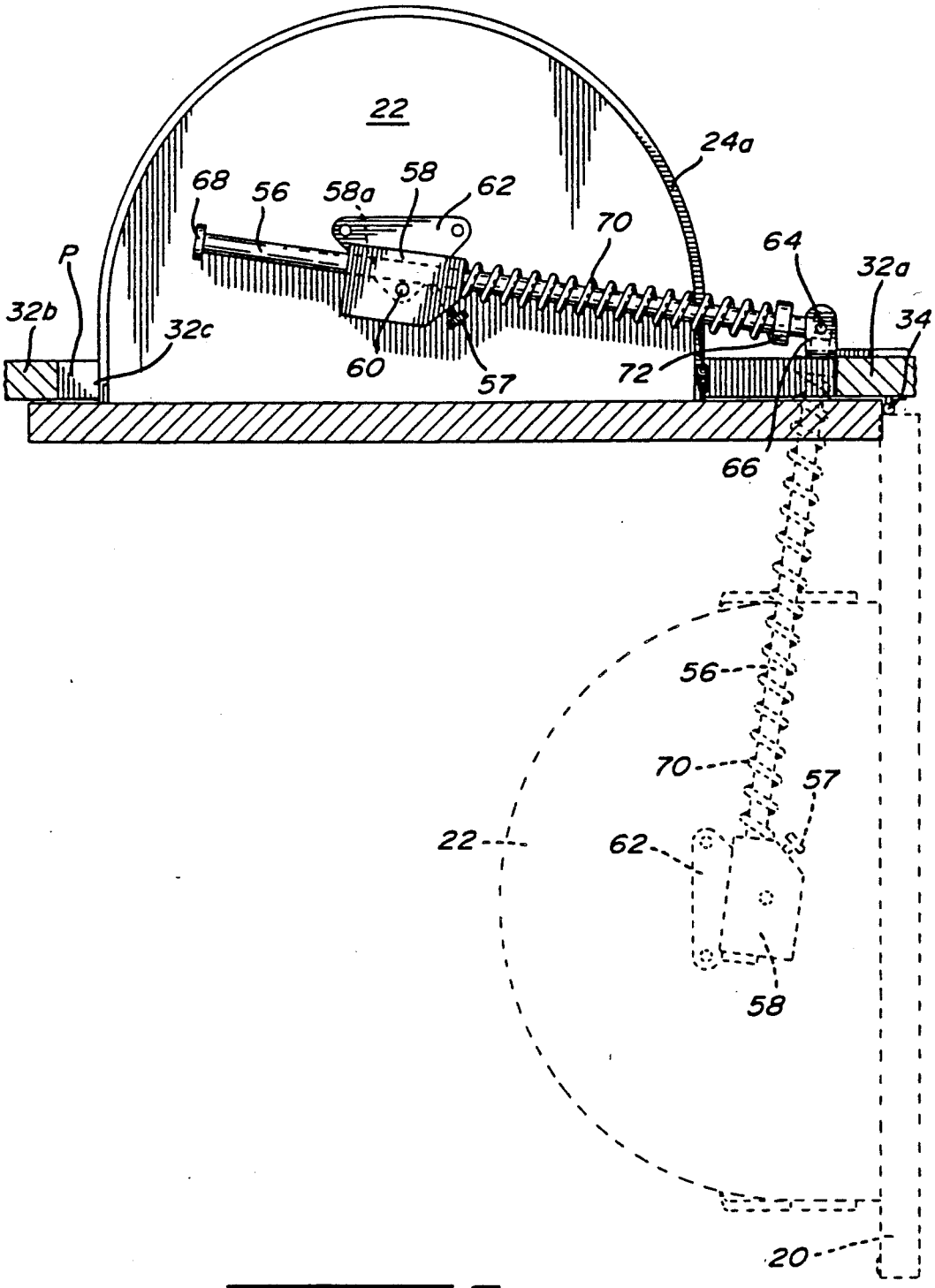
FIG. 8 is an enlarged bottom end view of the trash bin of FIG. 7 and a cross-sectional view of the cabinet door, showing in phantom lines the relative (pivotal) motion thereof.

Bin 14 (FIG. 7) is different from bin 14 of the first embodiment in that its side wall 24' has a horizontal top edge with diametrally opposite notches at the back to provide hooks 86 for attaching the top edge portion of a plastic trash bag inserted in the bin 14'. Lid 26' includes a downturned peripheral (semi-circular) flange 26*a*', which comes against the exterior face of the peripheral semi-circular upper section of the bin main wall 24' when lid 26' is closed. As illustrated in FIG. 7, lid 26' is pivoted to the upper rear section of the trash bin 16', about a horizontal stem 80, instead of laterally as in the first embodiment. Advantageously, the rear ends 82 of the upper section of main wall 24' define recesses 84 for providing sufficient play for the rear edge section of lid 26' and for limiting opening of lid 26' to a forwardly inclined position. A hole 87 is made in flange 26'*a* and is rearwardly spaced from pivot stem 80 for a purpose to be explained.

Figure 10:
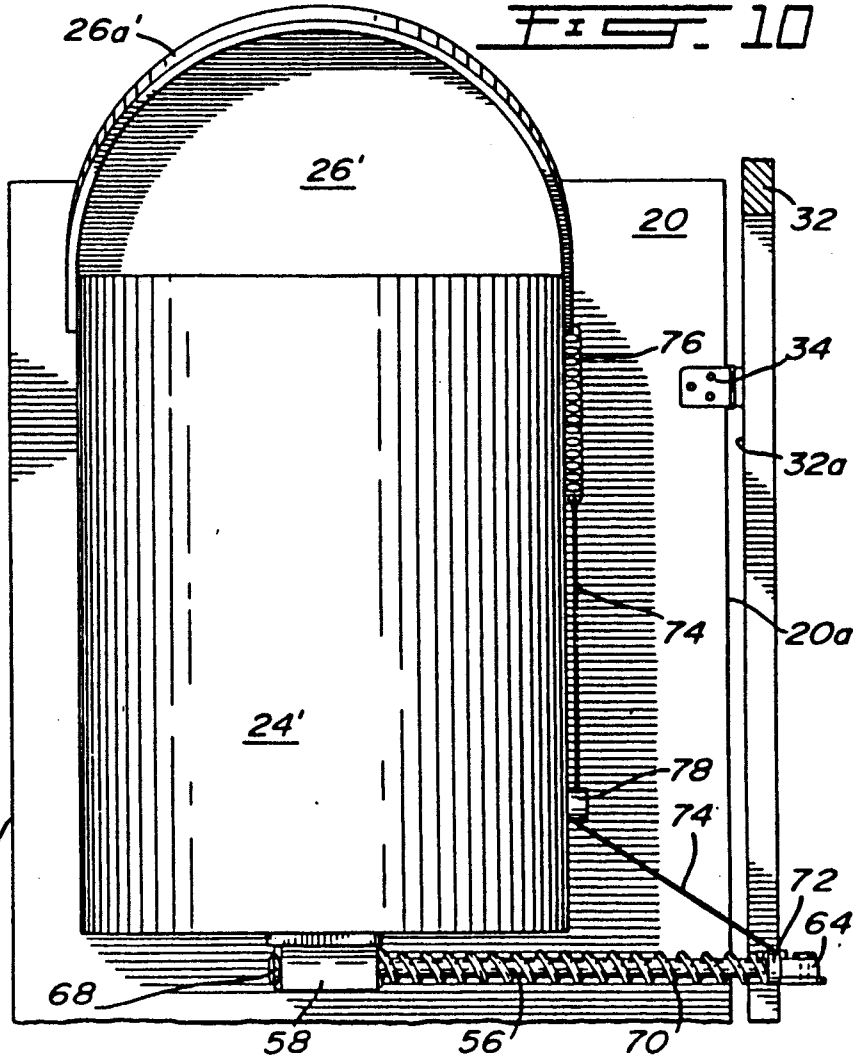
FIGS. 9 and 10 are front elevational views of the trash bin of FIG. 7, with the door and lid being both closed in FIG. 9 and opened in FIG. 10.
Figure 9:
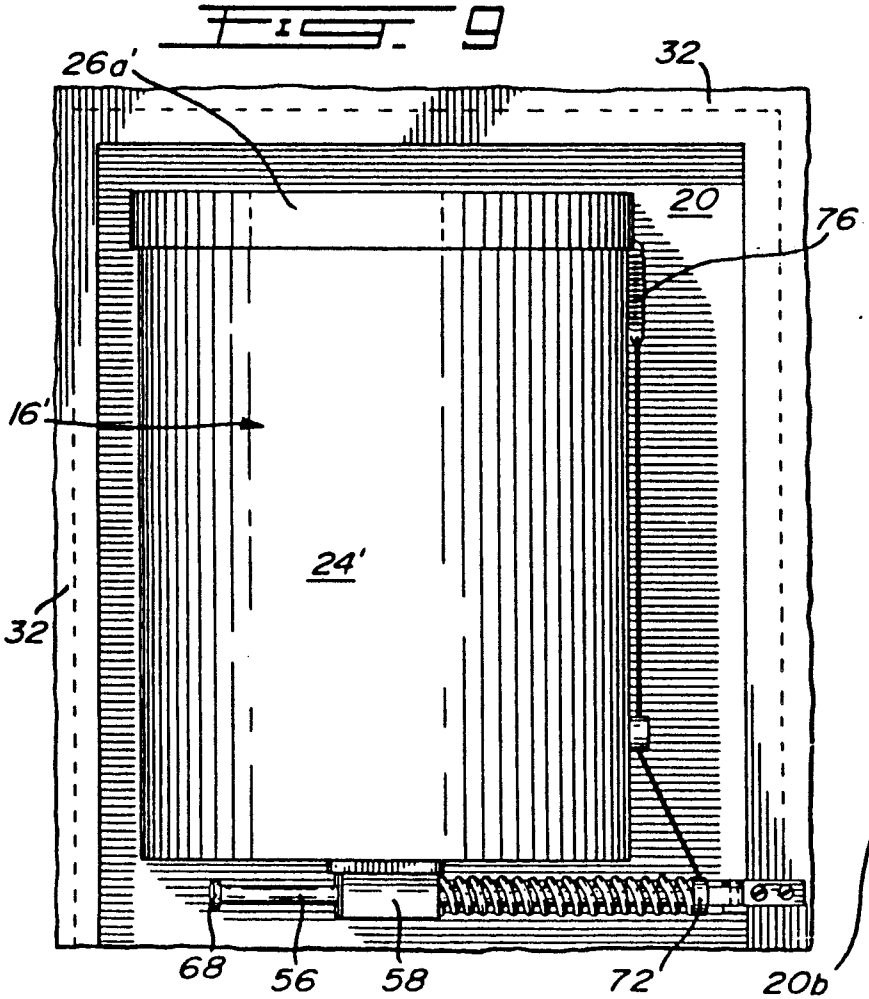

As clearly seen in FIGS. 9–10, the opening of lid 26 is actuated by a cord 74, which is anchored at one end to annular seat 72, is slidable through a guide block 78 fixed to wall 24' and is attached to one end of a tension coil spring 76 the other end of which is hooked into hole 87 of lid 26'. Spring 76 always keeps cord 74 taut. Opening of door 20 causes opening of lid 26' through cord 74. Closing of door 20 releases the tension in cord 74 and lid 26' closed under gravity.

It can now be understood that, as in the first embodiment of the invention, once the door latch is released, spring 70 will induce the closed door 20 to fully open. Indeed, because the vertical axes 34 and 64 of door 20 and rod 56 are horizontally offset, the spring 70 will bias rigid sleeve 58 to slide along the rod 56 fully toward head 68, without there being the need for manually pulling the door. During door opening, cord 74 will open lid 26'. The mounting of door opening mechanism 56 to 72 and of the lid opening assembly 74, 76 can be reversed with respect to bin 14' when the door 20 is hinged at its opposite side.

This invention is particularly designed for use with the non visible door hinges used for kitchen counters and cupboards. A conventional push-top magnetic latch such as latch A can be used in association with the door carrying the second embodiment of FIGs. 7 to 10. However latch A could be dispensed with and replaced by similar mechanism incorporated in rod 56 and sleeve 58.

I claim:

1. A trash bin assembly comprising a receptacle, a top lid therefor pivoted thereto about a lid pivotal axis for movement between an open and a closed position, said receptacle having a flat back wall mounted against the inside face of the door of a kitchen counter, hinged to a door frame which is part of said counter, and spring means carried by said receptacle and acting on said door frame and on said lid to bias both said door and said lid to open position after being opened a small amount or unlatched; wherein said spring means includes a spring member acting directly on said receptacle and on said lid to open the latter, and an elongated cam member carried by and over said lid and extending at an angle to said back wall, said cam member having a cam edge downwardly inclined in a direction away from aid back wall, said cam edge slidably engageable with the lintel of said door frame to cause door-opening movement through the opening of said lid under the action of said spring member.

2. A trash bin assembly as defined in claim 1, wherein said lid pivotal axis is substantially normal to said back wall, said cam member extending in a direction away from said back wall and protruding from said lid at a distance from said lid pivotal axis.

3. A trash bin assembly as defined in claim 2, wherein said cam edge defines a rear portion with a top, flat, substantially horizontal edge engaging the underside of said lintel in the closed position of said door and maintaining said lid in closed position.

4. A trash bin assembly as defined in claim 3, wherein said cam edge defines a steeply-inclined cam edge section following said top edge, in turn followed by a less-inclined cam edge section.

5. A trash bin assembly as defined in claim 4, wherein said receptacle has a top edge which is downwardly inclined away from said back wall, and said lid is downwardly inclined away from said back wall when in closed position.

6. A trash bin assembly as defined in claim 5, wherein said top lid is pivoted to said receptacle by means of a hinge member having two flat leaves, said top lid and said receptacle being provided with sockets on each side thereof for removably receiving said hinge leaves, whereby said lid can be pivoted to either side of said receptacle, the side selected being either the door on which the receptacle is mounted is a left-hand or a right-hand opening door.

7. A trash bin assembly as defined in claim 1, wherein said spring means includes a secured to the bottom of said receptacle, a sleeve pivotally mounted on said bracket for movement about an axis normal to said bottom, a rod member slidable in said sleeve transversely of said receptacle and under the same, said rod member having an outer end protruding from the side of said receptacle, a yoke pivotally mounted to said outer end of said rod and adapted to be fixed to a jamb of said door frame in such a position that the pivotal connection of the rod to the yoke be parallel to and spaced from the pivotal axis of said door to said door frame; an annular seat fixed to said rod adjacent said yoke; a compression coil spring surrounding said rod and extending between and abutting against said seat and said sleeve to bias said door to open position; and further including flexible cord means having one end attached to said rod adjacent said seat and the other end attached to said lid, said cord means including a flexible cord slidably extending through a guide block fixed to the side of said receptacle, said cord means causing opening of said lid upon opening movement of said door.

8. A trash bin assembly as defined in claim 7, further including stop means to limit the opening movement of said lid to an upwardly-inclined limit position, whereby said lid closes by gravity upon release of the tension of said cord means during closing movement of said door.

9. A trash bin assembly as defined in claim 6, wherein said spring member is a tension coil spring extending on the outside of said receptacle and selectively attachable to either side of said receptacle at one end and at the other end to a bar pivoted to the underside of said lid and swingeable to any of two positions protruding from a selected one of the two sides of said lid beyond the pivotal axis of said lid.

* * * * *